US005920249A

United States Patent [19]

Huss

[11] Patent Number: 5,920,249

[45] Date of Patent: Jul. 6, 1999

[54] PROTECTIVE METHOD OF SUPPORT FOR AN ELECTROMAGNETIC APPARATUS

[75] Inventor: John Bernard Huss, Ann Arbor, Mich.

[73] Assignee: Ford Motor Company, Dearborn, Mich.

[21] Appl. No.: 08/960,668

[22] Filed: Oct. 30, 1997

[51] Int. Cl.[6] ..... H01F 27/06; H01F 27/30

[52] U.S. Cl. ..... 336/65; 336/92; 336/197

[58] Field of Search ..... 336/65, 61, 90, 336/92, 100, 197, 210

[56] References Cited

U.S. PATENT DOCUMENTS

| | | | |
|---|---|---|---|
| 1,337,645 | 4/1920 | Doman . | |
| 1,526,882 | 11/1925 | Trimmer . | |
| 1,974,588 | 9/1934 | Snell | 336/100 |
| 2,574,417 | 11/1951 | Rowe | 175/356 |
| 2,858,357 | 10/1958 | McCulloch | 336/100 |
| 3,125,735 | 3/1964 | Twomey | 336/92 |
| 3,183,463 | 5/1965 | Wright | 336/92 |
| 4,711,135 | 12/1987 | Horiuchi et al. | 74/473 R |
| 4,888,572 | 12/1989 | Tinley | 336/65 |
| 4,899,122 | 2/1990 | Sommer | 336/65 |
| 5,210,513 | 5/1993 | Khan et al. | 336/61 |
| 5,289,153 | 2/1994 | Gross | 336/210 |
| 5,469,124 | 11/1995 | O'Donnell et al. | 336/61 |

FOREIGN PATENT DOCUMENTS

| | | |
|---|---|---|
| 26423 | 2/1977 | Japan . |
| 987672 | 1/1983 | Russian Federation . |

*Primary Examiner*—Michael L. Gellner
*Assistant Examiner*—Anh Mai
*Attorney, Agent, or Firm*—Roger L. May

[57] ABSTRACT

A method of assembling an electromagnetic device having a plurality of magnetic cores with substantially planar bases, by placing the magnetic cores upon a fixture adapted to align the planar bases of the magnetic cores in a coplanar relationship, applying a resilient adhesive along a core receiving side of a bracket, placing the bracket over the magnetic cores, pressing the bracket down upon the cores until the bracket's coplanar feet contact the fixture, removing the bracket and cores from the fixture, affixing a thermally conductive elastomeric pad along the coplanar bases of the magnetic cores, and fastening the coplanar feet to a thermally conductive plate so as to uniformly compress the elastomeric pad between the cold plate and the coplanar bases of the magnetic cores thereby providing a thermally efficient and shock resistant support mechanism.

13 Claims, 2 Drawing Sheets

PROTECTIVE METHOD OF SUPPORT FOR AN ELECTROMAGNETIC APPARATUS

FIELD OF THE INVENTION

The present invention relates to an automotive electromagnetic apparatus, and more specifically, to a protective method of support for such an apparatus.

BACKGROUND OF THE INVENTION

In the development of an electronic automotive vehicle many problems invariably arise. One set of problems is associated with the use of an electromagnetic apparatus in a vehicular environment. An electromagnetic apparatus has magnetic cores. These magnetic cores generate heat which must be dissipated. One way of cooling an electromagnetic device is to place the magnetic cores of the apparatus in direct contact with a metallic heat sink. The heat sink acts to draw heat away from the cores, and thereafter dissipate the heat.

However, in a vehicular environment such an arrangement is undesirable. The magnetic core, a sintered powder metal iron, is very brittle and will crack and chip under very low stresses. Placing the magnetic cores in direct contact with a metallic heat sink can cause damage to and possible failure of the core. Using such an arrangement in harsh vibrating environments as found in automotive vehicles only exacerbates this problem.

One approach to remedy this problem is to apply a thermally conductive elastomeric pad to the base of the cores prior to placing them in contact with the heat sink. However, this may create other problems. The manufacture of magnetic cores is a very inexact science in which the height of the cores may vary ±2.0 mm. In order to have a thermally efficient heat transfer between the heat sink and the cores, it is preferred that the bases of the cores be equidistant from the heat sink. The high tolerance associated with the manufacture of the cores makes aligning the bases of the cores prior to applying the elastomeric pad a cumbersome and inexact process.

Accordingly, it is seen that a need exists in the art for a protective method of support for an electromagnetic apparatus which insulates the magnetic cores from damage due to vibration while providing efficient cooling of the cores.

SUMMARY OF THE INVENTION

Responsive to the deficiencies in the prior art, the present invention provides a method of supporting an electromagnetic apparatus having a plurality of magnetic cores with substantially planar bases aligned in coplanar relationship by a fixture with a planar fixture surface and a central planar base receiving portion elevated a predetermined distance thereabove and parallel thereto, a transformer, and a plurality of inductors. The method of support includes the steps of placing a bracket over the magnetic cores, the bracket having a top portion with a core receiving side and a plurality of leg portions with outwardly projecting coplanar feet extending a predetermined distance beyond the coplanar bases of the magnetic cores, affixing an elastomeric pad along the coplanar bases of the magnetic cores, the elastomeric pad having a substantially planar pad surface parallel to the coplanar feet and the coplanar bases, the planar pad surface extending a predetermined distance beyond the coplanar feet, and fastening the coplanar feet to a thermally conductive plate so as to uniformly compress the elastomeric pad between the cold plate and the coplanar bases of the magnetic cores thereby providing a thermally efficient cooling and shock resistant support mechanism.

According to a feature of the present invention, the method further includes the step of applying a resilient adhesive along the core receiving side of the bracket so as to fasten the bracket to the magnetic cores.

An advantage of the present invention is that the support method provides the electromagnetic apparatus with a thermally efficient cooling and shock resistant support structure.

BRIEF DESCRIPTION OF THE DRAWINGS

Other features and advantages of the present invention will become apparent to those skilled in the automotive vehicle body related arts upon reading the following description with reference to the accompanying drawings, in which.

DETAILED DESCRIPTION OF THE PREFERRED EMBODIMENT

Figure 5:
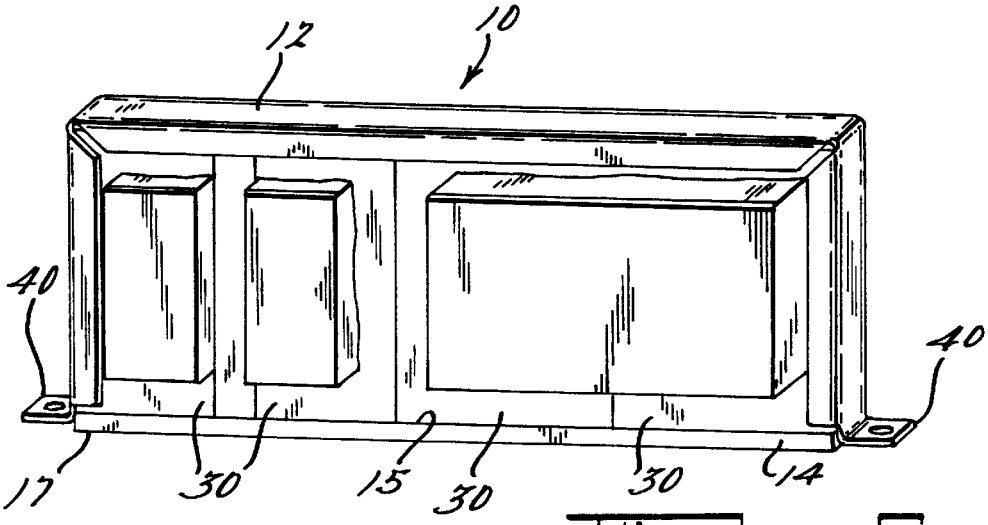
FIG. 5 is perspective view of an electromagnetic apparatus support mechanism with a base mounted elastomeric pad according to the present invention.
Figure 6:
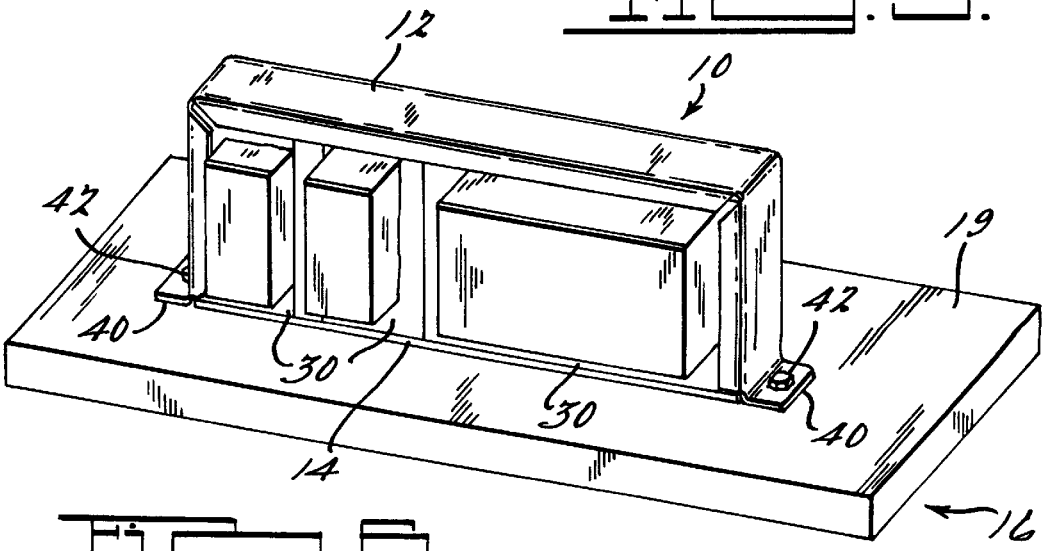
FIG. 6 is a perspective view of an electromagnetic apparatus support mechanism mounted upon a thermally conductive plate according to the present invention.

Turning now to the drawings, and in particular to FIGS. 5 and 6 thereof, an electromagnetic apparatus support mechanism 10 is shown. The support mechanism 10 has a bracket 12, an elastomeric pad 14, and a thermally conductive plate 16. The support mechanism 10 is assembled utilizing a fixture 18 as shown in FIG. 1.

Figure 1:
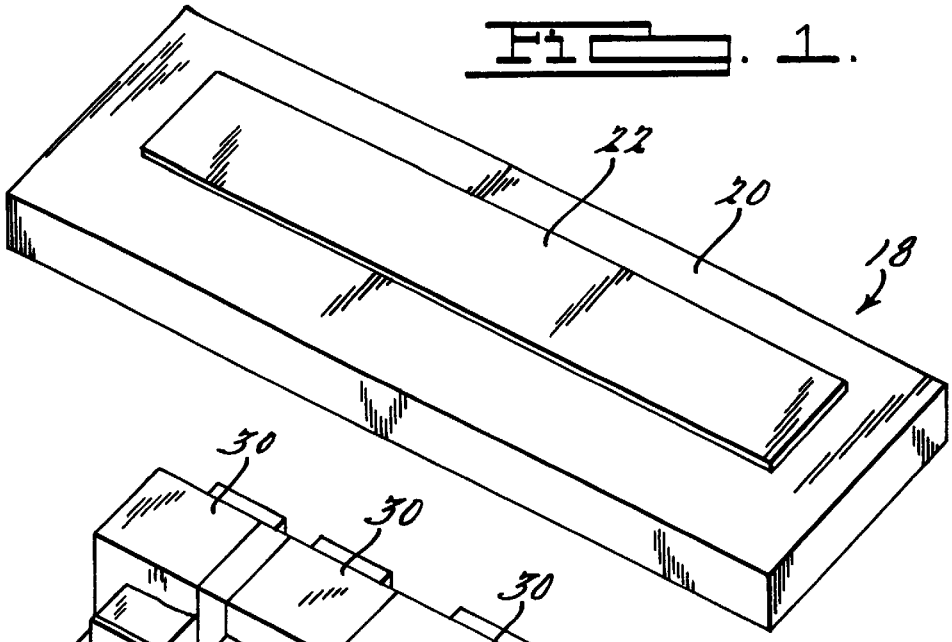
FIG. 1 is a perspective view of a fixture for an electromagnetic apparatus.

As shown in FIG. 1, the fixture 18 is substantially rectangular and has a planar fixture surface 20. A planar base receiving surface 22 is located central to the fixture surface 20. The base receiving surface 22 is elevated a predetermined distance above and parallel to the fixture surface 20.

Figure 2:
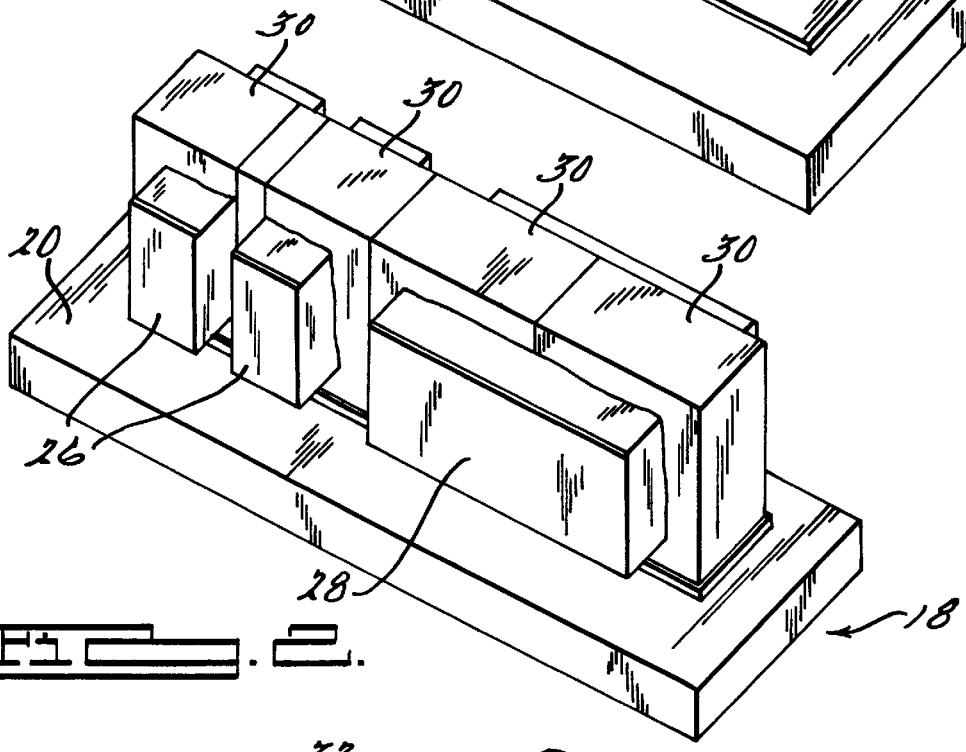
FIG. 2 is a perspective view of an electromagnetic apparatus placed upon a fixture according to the present invention.

As shown in FIG. 2, an electromagnetic apparatus may have a pair of inductors 26, a transformer 28, and a plurality of magnetic cores 30. The manufacturing tolerances of the cores 30 may be as high as ±2.0 mm. Each inductor 26 and the transformer 28 has a corresponding magnetic core 30.

Figure 3:
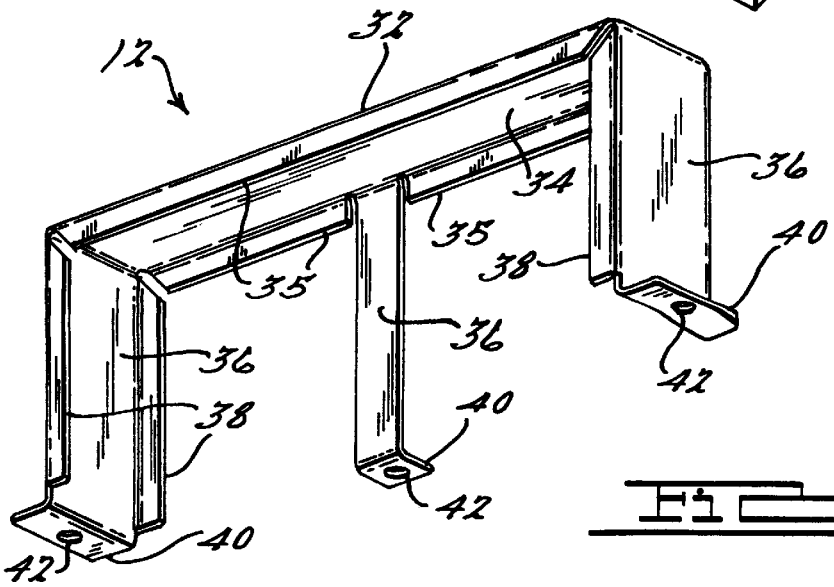
FIG. 3 is a perspective view of a bracket for an electromagnetic apparatus according to the present invention.

The bracket 12, as shown in FIG. 3, has a planar top portion 32 and a core receiving side 34. Projecting downward from the top portion 32 are flanges 35 which are adapted to receive the magnetic cores 30, and thereby restrict lateral movement of the cores 30. Also projecting downward from the top portion 32 are a plurality of leg portions 36 of equal, predetermined length. The leg portions 36 have inwardly directed flanges 38 which are also adapted to receive the magnetic cores 30. Projecting outward of the leg portions 36 are a plurality of coplanar feet 40. The feet 40 have holes 42 therein for receiving a conventional fastener, such as a screw (not shown), therethrough.

As shown in FIG. 5, an elastomeric pad 14 is formed in a substantially rectangular shape with a predetermined thickness. The pad 14 has a planar adhesive surface 15 and a planar base surface 17 parallel to the adhesive surface. The pad 14 is preferably thermally conductive.

As shown in FIG. 6, the thermally conductive plate 16 is substantially rectangular with an upper, electromagnetic apparatus receiving surface 19. The plate 16 has fastener receiving holes (not shown) which are adapted to align with the holes 42 of the bracket 12 during assembly. The plate 16 is preferably made out of a metal with high thermal conductivity such as aluminum.

Figure 4:
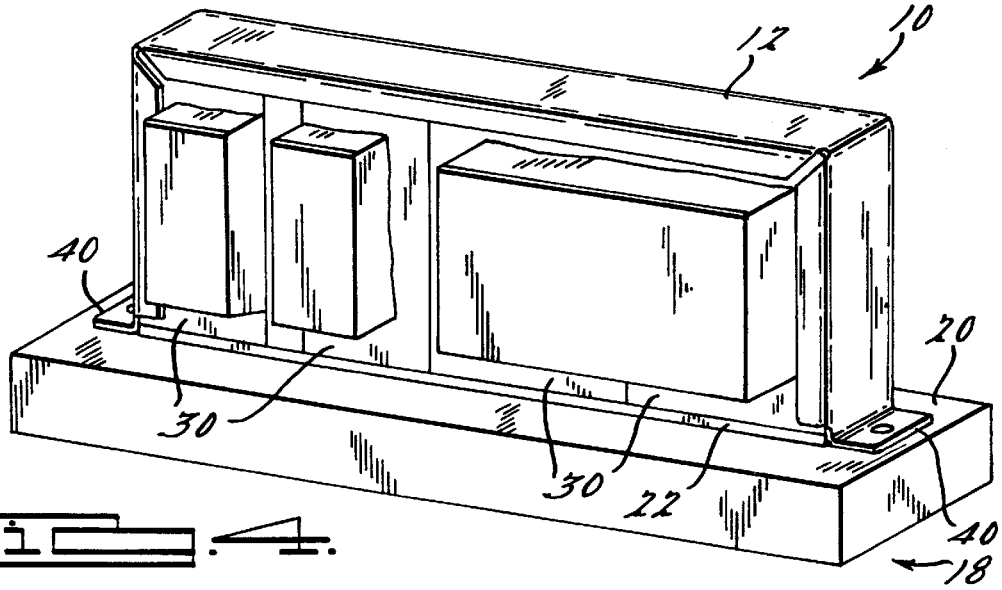
FIG. 4 is a perspective view of a bracket mounted upon an electromagnetic apparatus utilizing a fixture according to the present invention.

In assembly, the fixture 18 of FIG. 1 is placed on a flat surface. As shown in FIG. 2, the magnetic cores 30 are then placed and aligned on the base receiving surface 22 of the fixture 18 and bonded together in conventional fashion. The bases of the magnetic cores 30 thereby form a coplanar base surface such that any tolerance variance of the cores 30 is realized on the top side. A resilient adhesive, such as a silicon adhesive (not shown), is then applied to the core receiving side 34 of the bracket 12 as shown in FIG. 3. As shown in FIG. 4, the bracket 12 is then placed over the magnetic cores 30 so that the feet 40 come into coplanar contact with the planar fixture surface 20. This contact insures that the coplanar feet 40 extend a predetermined distance beyond, and are parallel with, the coplanar bases of the magnetic cores 30. After the adhesive cures affixing the bracket 12 to the magnetic cores 30, the assembly is removed from the fixture 18. As shown in FIG. 5, the planar adhesive surface 15 of the elastomeric pad 14 is then brought into contact with the bases of the magnetic cores 30. The planar base surface 17 of the pad 14 extends a predetermined distance beyond, and is parallel with, the coplanar bases of the magnetic cores 30 as well as the coplanar feet 40. As shown in FIG. 6, the holes 42 of the feet 40 are aligned with the fastener receiving holes of the upper receiving surface 19 of the thermally conductive plate 16. A conventional fastener is then used to attach the bracket 12 to the plate 16. As the fasteners are tightened the pad 14 is uniformly compressed between the bases of the magnetic cores 30 and the plate 16.

The resulting electromagnetic apparatus support mechanism 10 is advantageous for a number of reasons. First, the only points of contact of the magnetic cores 30 are with the resilient adhesive of the bracket 12 and the elastomeric pad 14. This arrangement provides a protective cushion for the brittle magnetic cores 30 and helps to prevent cracking and chipping. Second, the coplanar bases of the magnetic cores 30 are in a coplanar relationship and they are parallel with the planar base surface 17 of the pad 14 as well as the coplanar feet 40 of the bracket 12. Thus, upon fastening of the bracket 12 to the plate 16, the pad 14 is evenly compressed and the bases of the magnetic cores 30 are thereby parallel to, and equidistant from, the plate 16. This arrangement provides an even and efficient thermal transfer between the cores 30 and the plate 16 via the pad 14.

Only one embodiment of a method of supporting an electromagnetic apparatus for an electric automotive vehicle of the present invention has been described. Those skilled in the automotive mechanical arts will appreciate that others may be possible without departing from the scope of the following claims.

I claim:

1. A method of assembling an electromagnetic apparatus in a thermally efficient cooling and shock resistant manner comprising the steps of:

aligning a plurality of magnetic cores having substantially planar bases upon a fixture so that the bases are in coplanar relationship, the fixture having a planar fixture surface and a central planar base receiving portion elevated a predetermined distance above and parallel to the planar fixture surface, placing a bracket over the magnetic cores in partially surrounding and supportive relationship, the bracket having a top portion with a core receiving side and a plurality of leg portions with outwardly projecting coplanar feet extending a predetermined distance beyond the coplanar bases of the magnetic cores;

affixing an elastomeric pad along the coplanar bases of the magnetic cores, the elastomeric pad having a substantially planar pad surface parallel to the coplanar feet and the coplanar bases, the planar pad surface extending a predetermined distance beyond the coplanar feet; and fastening the coplanar feet to a thermally conductive plate so as to uniformly compress the elastomeric pad between the thermally conductive plate and the coplanar bases of the magnetic cores.

2. A method according to claim 1, wherein the predetermined distance above the planar fixture surface is equal to the predetermined distance the feet extend beyond the coplanar bases of the magnetic cores.

3. A method according to claim 1, wherein the bracket further includes inwardly projecting flange portions adapted to receive the magnetic cores.

4. A method according to claim 1, wherein the elastomeric pad is a thermally conductive elastomeric pad.

5. A method according to claim 1, further including the step of applying a resilient adhesive along the core receiving side of the bracket so as to fasten the bracket to the magnetic cores in supportive and shock absorptive fashion.

6. A method of supporting an electromagnetic apparatus having a plurality of magnetic cores with substantially planar bases, the method comprising the steps of:

aligning the planar bases of the magnetic cores in coplanar relationship upon a fixture;

placing a bracket over the magnetic cores in partially surrounding relationship, the bracket having a top portion with a core receiving side and a plurality of leg portions with outwardly projecting coplanar feet extending a predetermined distance beyond the coplanar bases of the magnetic cores;

removing the bracket and cores from the fixture;

affixing an elastomeric pad to the coplanar bases of the cores, the elastomeric pad having a substantially planar pad surface parallel to the coplanar feet and the coplanar bases, the planar pad surface extending a predetermined distance beyond the coplanar feet; and attaching the coplanar feet to a conductive plate so as to uniformly compress the elastomeric pad between the thermally conductive plate and the coplanar bases of the magnetic cores thereby providing a thermally efficient and shock resistant support mechanism.

7. A method according to claim 6, wherein the fixture has a planar fixture surface and a central planar portion elevated a predetermined distance above and parallel to the planar fixture surface.

8. A method according to claim 6, wherein the predetermined distance above the planar fixture surface is equal to the predetermined distance the feet extend beyond the coplanar bases of the magnetic cores.

9. A method according to claim 6, wherein the bracket further includes inwardly projecting flange portions adapted to receive the magnetic cores.

10. A method according to claim 6, wherein the elastomeric pad is a thermally conductive elastomeric pad.

11. A method according to claim 6, further including the step of applying a resilient adhesive along the core receiving side of the bracket for fastening the bracket to the magnetic cores in a supportive and shock absorptive relationship.

12. A method of support for an electromagnetic assembly for an automotive vehicle, comprising the steps of:

assembling an electromagnetic device having a plurality of magnetic cores with substantially planar bases;

placing the magnetic cores upon a fixture having a planar elevated portion and a planar recessed portion being parallel to and terminating a predetermined distance therefrom, the elevated portion adapted to align the planar bases of the magnetic cores in a coplanar relationship;

applying a resilient adhesive along a core receiving side of a bracket for fastening the bracket to the magnetic cores;

placing the bracket over the magnetic cores in partially surrounding relationship, the bracket further having inwardly projecting flange portions and a plurality of leg portions with inwardly projecting flange portions and outwardly projecting coplanar feet, the flange portions of the top and leg portions being in receiving relationship with the magnetic cores and the coplanar feet extending a predetermined distance beyond the coplanar bases of the magnetic cores;

pressing the bracket down upon the cores until the coplanar feet contact the planar recessed portion;

removing the bracket and cores from the fixture;

affixing a thermally conductive elastomeric pad along the coplanar bases of the magnetic cores, the elastomeric pad having a substantially planar surface parallel to the coplanar feet and the coplanar bases, the planar surface extending a predetermined distance beyond the coplanar feet; and fastening the coplanar feet to a thermally conductive plate so as to uniformly compress the elastomeric pad between the thermally conductive plate and the coplanar bases of the magnetic cores thereby providing a thermally efficient and shock resistant support mechanism.

13. A method according to claim 12, wherein the distance between the planar elevated portion and the planar recessed portion is equal to the predetermined distance the feet extend beyond the coplanar bases of the magnetic cores.

* * * * *